US005205426A

United States Patent [19]

McBride et al.

[11] Patent Number: 5,205,426

[45] Date of Patent: Apr. 27, 1993

[54] TAMPER-INDICATING PLASTIC CLOSURE

[75] Inventors: Stephen W. McBride, Brownsburg; Thomas J. McCandless, Crawfordsville, both of Ind.

[73] Assignee: H-C Industries, Inc., Crawfordsville, Ind.

[21] Appl. No.: 847,544

[22] Filed: Mar. 13, 1992

Related U.S. Application Data

[63] Continuation-in-part of Ser. No. 682,635, Apr. 9, 1991, Pat. No. 5,167,335.

[51] Int. Cl.[5] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| Re. 33,265 | 7/1990 | Gregory et al. . | |
| 4,402,418 | 9/1983 | Ostrowsky . | |
| 4,470,513 | 9/1984 | Ostrowsky . | |
| 4,550,844 | 11/1985 | Lininger . | |
| 4,613,052 | 9/1986 | Gregory et al. . | |
| 4,635,808 | 1/1987 | Nolan . | |
| 4,709,824 | 12/1987 | Thompson . | |
| 4,715,506 | 12/1987 | McLaren . | |
| 4,759,456 | 7/1988 | Kusz . | |
| 4,784,280 | 11/1988 | Breuer et al. | 215/252 |
| 4,801,030 | 1/1989 | Barriac . | |
| 4,848,614 | 7/1989 | Csaszar | 215/252 |
| 4,938,370 | 7/1990 | McBride . | |
| 4,978,017 | 12/1990 | McBride . | |
| 5,090,788 | 2/1992 | Ingram et al. . | |
| 5,107,998 | 4/1992 | Zumbuhl | 215/252 |

*Primary Examiner*—Allan N. Shoap
*Assistant Examiner*—Nova Stucker
*Attorney, Agent, or Firm*—Dressler, Goldsmith, Shore, Sutker & Milnamow, Ltd.

[57] ABSTRACT

A tamper-indicating plastic closure includes a plastic closure cap having a top wall portion, and a depending cylindrical skirt portion, and an annular pilfer band depending from the skirt portion. The pilfer band includes a plurality of circumferentially spaced flexible tabs, and an annular interference bead, with the arrangement configured to provide two modes of tamper-indicating interaction with an associated container. In order to facilitate high-speed application of the closure to a container, each of the flexible tabs includes a relatively thick central portion, operative during the second mode of tamper-indication, and an adjacent base portion of relatively reduced thickness for enhanced flexibility.

10 Claims, 4 Drawing Sheets

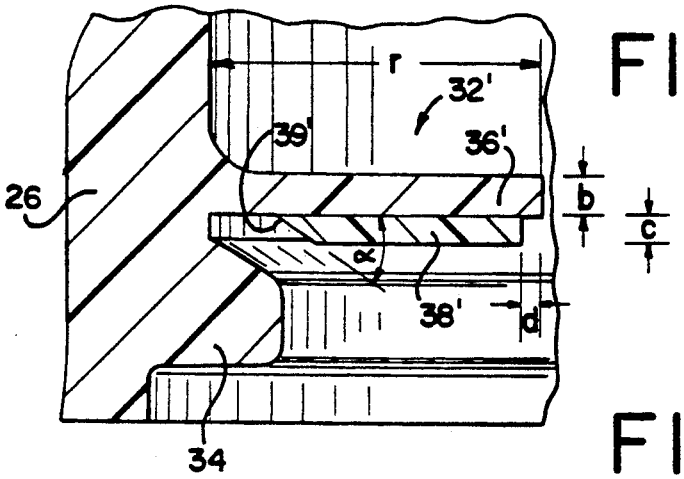
FIG. 7
FIG. 8
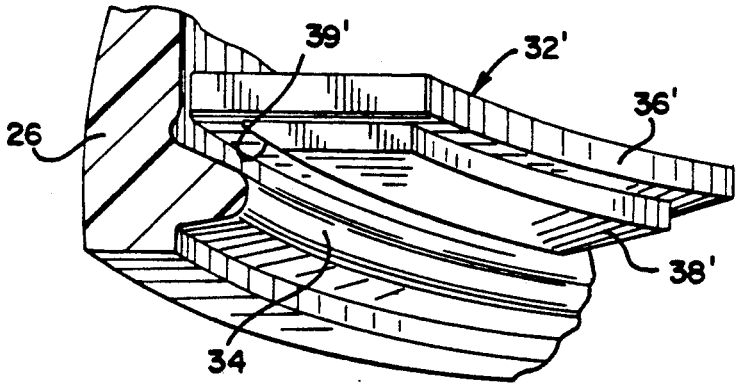
FIG. 9
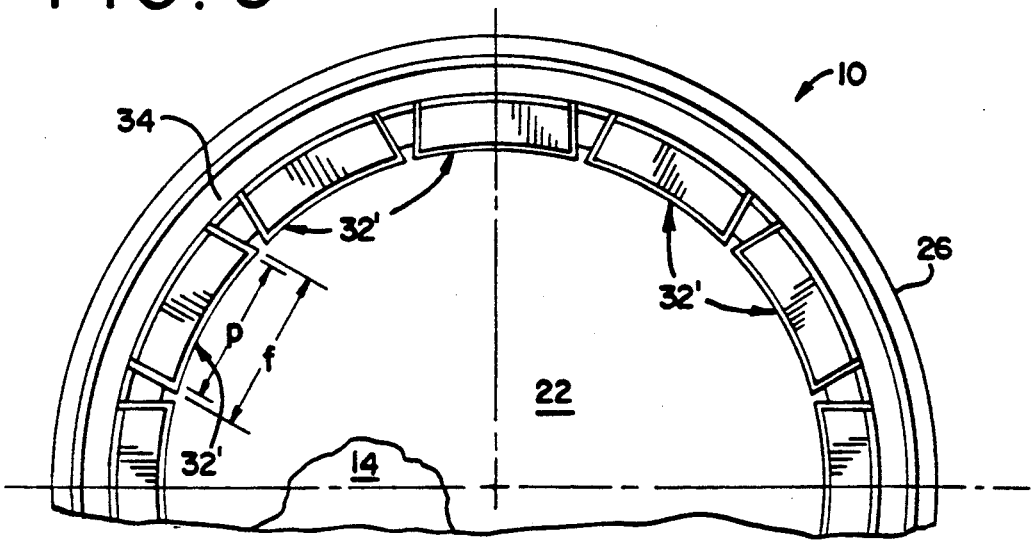

TAMPER-INDICATING PLASTIC CLOSURE

CROSS-REFERENCE TO RELATED APPLICATIONS

This application is a continuation-in-part of U.S. patent application Ser. No. 07/682,635, filed Apr. 9, 1991 U.S. Pat. No. 5,167,355.

TECHNICAL FIELD

The present invention relates generally to tamper-indicating closures for containers, and more particularly to a tamper-evident plastic closure including a pilfer band configured for enhanced flexibility having container-engaging projections to facilitate application of the closure to a container with high-speed application equipment.

BACKGROUND OF THE INVENTION

Tamper-indicating or tamper-evident packaging for food products and beverages assures consumers that products are fresh and unadulterated when purchased. U.S. Pat. No. 4,938,370, to McBride, illustrates a tamper-indicating plastic closure construction for use in connection with a bottle or like container having a threaded neck. The closure disclosed in this patent is particularly desirable in that two different modes of tamper-indication are provided, thus enhancing its tamper-resistance.

Specifically, the closure of this patent includes an annular pilfer band which is at least partially detachably joined to the bottom of a cylindrical skirt portion of an upper closure cap. For tamper-indication, the pilfer band includes a plurality of circumferentially spaced, relatively flexible tab elements which extend inwardly of the pilfer band for coaction with an annular locking ring on an associated container.

During application of the closure to a container, the flexible tabs are urged upwardly. When the closure is fully seated on the container, the tabs assume a more inwardly extending disposition, for coaction with the container locking ring so that the pilfer band is detached from the skirt portion during closure removal. Additionally, the pilfer band includes an annular interference bead positioned generally beneath the flexible tabs. In the event that the pilfer band does not initially detach from the closure skirt portion, by virtue of the tabs interacting with the container in their initial upwardly and inwardly extending disposition, the tabs can further function to cooperate with the interference bead. This is achieved by configuring the tabs and the interference bead to together provide a combined thickness which acts to reduce the effective inside diameter of the pilfer band, thereby providing the desired interfering engagement with the container locking ring for separating the pilfer band from the closure cap.

As will be appreciated, the upward flexing movement of the flexible tabs during closure application creates stresses on the closure, including stress on the frangible connection which detachably connects the pilfer band to the closure skirt portion. Attendant to high-speed application with modern bottling equipment, the stresses exerted on the frangible connection can be relatively high. This poses somewhat of a dilemma, in that the frangible connection must be configured to consistently and easily fracture and break attendant to closure removal, while at the same time be sufficiently strong to resist premature breakage during high-speed application.

The present invention contemplates an improved construction for a tamper-indicating closure of the above type, which construction facilitates high-speed closure application without compromise of the reliable performance of the closure.

SUMMARY OF THE INVENTION

The tamper-indicating plastic closure of the present invention facilitates high-speed closure application by reducing the stresses to which the closure is subjected during application. This is achieved by configuring the flexible tab elements of the closure pilfer band for enhanced flexibility, while at the same time assuring operability in the two different modes of tamper-indication. In particular, at least some of the flexible tabs are configured for enhanced flexibility by including a base portion of relatively reduced thickness for enhanced flexibility, as well as a locally thickened portion for the desired coaction with an interference bead of the pilfer band.

In accordance with the illustrated embodiment, the present tamper-indicating plastic closure is configured for use with a container having an annular locking ring. The closure comprises a plastic cap including a top wall portion, and an annular depending cylindrical skirt portion. In the preferred form, a helical thread formation is provided on the inside surface of the skirt portion for coaction with a like thread formation on the exterior finish of the associated container.

The closure further includes an annular pilfer band at least partially detachably connected to and depending from the skirt portion of the closure. The pilfer band includes an annular band portion, and a plurality of circumferentially spaced inwardly extending flexible tabs. Each flexible tab has a free end portion which is engageable with the container locking ring when the flexible tabs extend upwardly and inwardly during removal of the closure from the container. By this arrangement, a first means or mode for tamper-indication is provided, with the tabs coacting with the container to at least partially detach the pilfer band from the skirt portion of the closure.

The pilfer band further includes an inwardly extending annular interference bead positioned beneath and adjacent to the flexible tabs. A second means or mode of tamper-indication is provided by disposition of the flexible tabs in a generally downwardly, inwardly extending orientation, between the container locking ring and the interference bead of the pilfer band. When the flexible tabs are arranged in this disposition, the effective inside diameter of the pilfer band is reduced, thereby effecting the desired interfering engagement with the container locking ring for at least partially detaching the pilfer band from the skirt portion.

In accordance with the present invention, at least some of the flexible tabs are configured for enhanced flexibility, thereby facilitating high-speed application to containers with relatively reduced stressing of the closure. These tabs include a relatively thick central portion, and a base portion having a relatively reduced thickness to enhance the flexibility of the tab. In order to provide the desired second mode of tamper-indication, each of the relatively thick central portions is positionable between the associated container locking ring and the interference bead of the pilfer band.

In the preferred, illustrated form, each of the flexible tabs has a generally planar configuration, with the relatively thick central portion comprising a discrete, elongated pad or node on a lower surface of the planar portion of the tab.

In accordance with the illustrated embodiment, a preferred frangible connection for at least partially detachably connecting the pilfer band to the closure skirt comprises a plurality of circumferentially spaced, frangible ribs or bridges which extend between the inside surfaces of the skirt portion and the annular band portion of the pilfer band. The pilfer band is otherwise separated and distinguished from the skirt portion by a circumferentially extending score line which extends at least partially around the closure. The score line extends partially into the frangible ribs, thereby defining a fracturable "residual" portion for each rib.

As noted, each of the flexible tabs configured for enhanced flexibility includes a base portion of relatively reduced thickness. In the preferred form, each of these flexible tabs also includes a free end portion of relatively reduced thickness, which is preferably of substantially equal thickness to the base portion.

Other features and advantages of the present invention will become readily apparent from the following detailed description, the accompanying drawings, and the appended claims.

BRIEF DESCRIPTION OF THE DRAWINGS

FIG. 7 is a fragmentary, cross-sectional view illustrating an alternate embodiment of a flexible tab of the pilfer band of the present closure;

FIG. 8 is a fragmentary, perspective view, in partial cross-section, of the flexible tabs shown in FIG. 7;

FIG. 9 is a partial bottom plan view of the present tamper-indicating plastic closure, including the flexible tabs illustrated in FIGS. 7 and 8;

DETAILED DESCRIPTION

Figure 1:
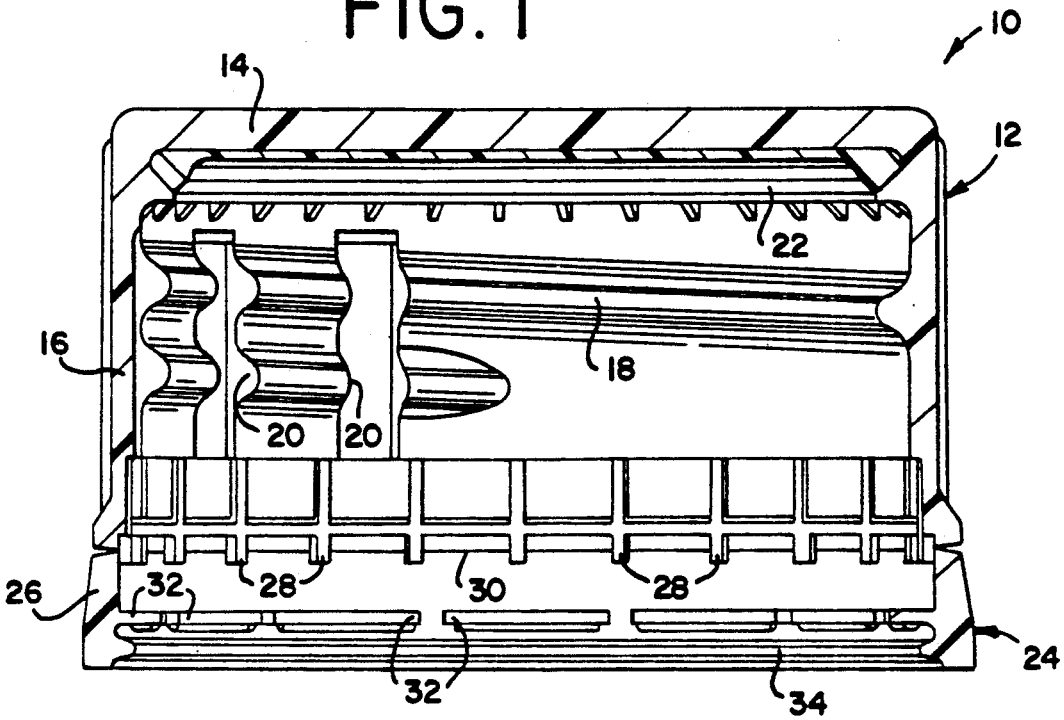
FIG. 1 is a cross-sectional view of a tamper-indicating plastic closure embodying the principles of the present invention.
Figure 2:
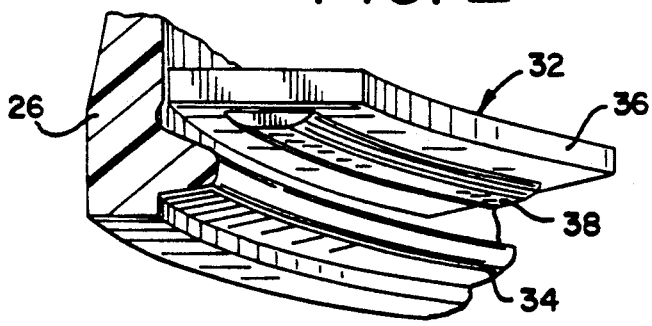
FIG. 2 is a relatively enlarged, fragmentary perspective view illustrating a flexible tab of a pilfer band of the closure shown in FIG. 1.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to FIG. 1, therein is illustrated a tamper-evident plastic closure 10 embodying the principles of the present invention. The plastic closure 10 includes an upper plastic closure cap or shell 12, preferably formed from polypropylene, which includes a circular top wall portion 14, and a depending, annular cylindrical skirt portion 16. The skirt portion 16 includes an internal, helical thread formation 18 for mating with a like thread formation on the exterior finish of an associated container.

The illustrated embodiment of the closure 10 is particularly configured for use with containers for carbonated beverages, and to this end, a plurality of axially extending vent grooves 20 are provided in the skirt portion 16, generally traversing the thread formation 18. Additionally, the closure may include a sealing liner 22 adjacent the top wall portion 14, which is configured for sealing engagement with the associated container.

In order to provide a clear visual indication of partial or complete removal of the closure 10 from an associated container, the closure includes an annular pilfer band 24 depending from the lower edge of skirt portion 16. The pilfer band 24 is at least partially detachably connected to the skirt portion 16, with the pilfer band being configured for cooperative interaction with an locking ring L (FIGS. 5 and 6) of an associated container for at least partially detaching and separating the pilfer band from the closure skirt portion.

The pilfer band 24 includes an annular band portion 26. The desired frangible connection between the pilfer band and the closure skirt portion is preferably provided by a plurality of circumferentially spaced, frangible rib-like bridges 28 which extend between the inside surfaces of the skirt portion 16 and the band portion 26 of the pilfer band. The pilfer band is otherwise separated and distinguished from the skirt portion of the closure cap 12 by a circumferential score line 30 which extends through the side wall of the closure construction, and partially into the frangible ribs 28.

By this arrangement, each of the frangible ribs 28 defines an unscored "residual" portion, which residual portions collectively provide a frangible connection between the pilfer band and the closure cap. For those applications where it is desired that the pilfer band 24 completely separate from the closure cap upon fracture and breaking of the frangible bridges 28, the score line 30 can extend substantially completely about the circumference of the closure. In distinction, for some applications it is desirable to have the pilfer band remain attached to the closure cap, after partial separation of the closure therefrom. In such an arrangement, the band portion 26 of the pilfer band can be configured to break and split in one or more regions, attendant to failure of the frangible bridges 28, with the one or more pieces of the pilfer band thereafter remaining attached to the skirt portion of the closure by one or more areas exhibiting relatively greater strength than the bridges 28.

In accordance with the teachings of U.S. Pat. No. 4,938,370, incorporated herein by reference, the pilfer band 24 of the plastic closure 10 is desirably configured to provide two modes or arrangements for interacting with the locking ring L of the associated container, thus effecting partial or complete separation of the pilfer band from the closure skirt portion by fracture of the bridges 28. Specifically, the pilfer band 24 includes a plurality of circumferentially spaced, inwardly extending flexible tabs 32 which extend integrally inwardly of the band portion 26. Additionally the pilfer band includes an inwardly extending, annular interference bead 34 positioned generally beneath the flexible tabs 32.

Figure 6:
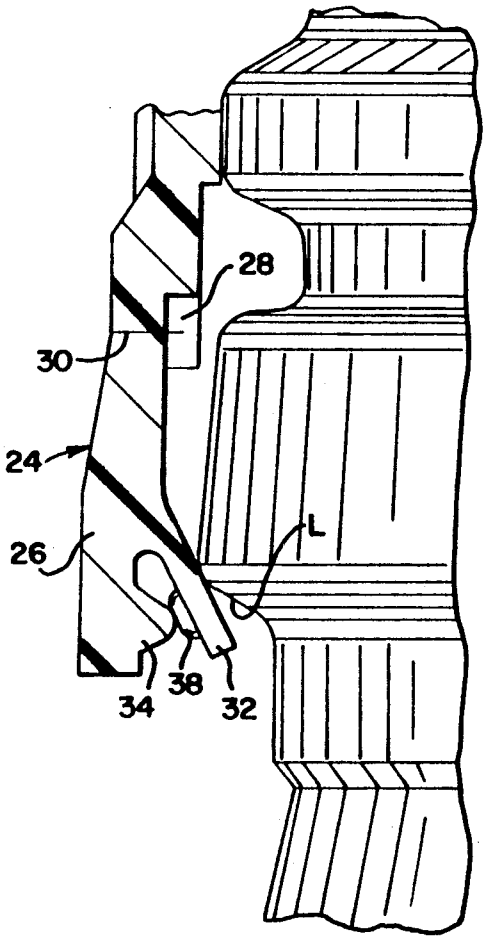
FIG. 6 is a view similar to FIG. 5 illustrating the present closure in a second mode of tamper-indication.
Figure 5:
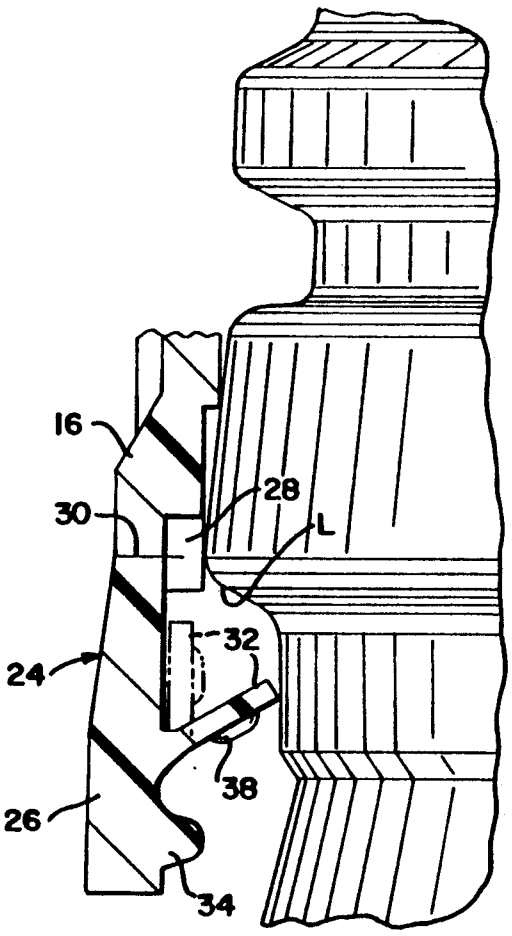
FIG. 5 is a fragmentary view illustrating the action of the present tamper-indicating closure in a first mode of tamper-indication.
Figure 10:
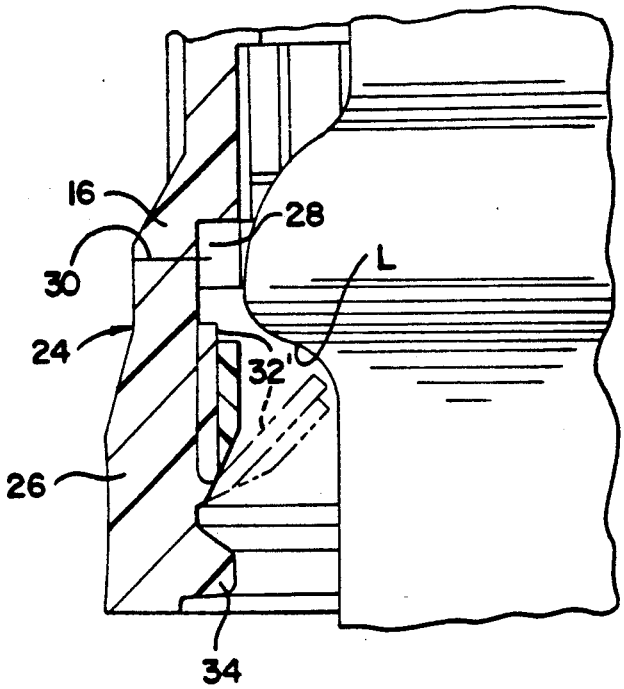
FIG. 10 is a fragmentary, cross-sectional view illustrating the present tamper-indicating closure, including the flexible tabs of FIGS. 7–9, in a first mode of tamper-indication.

The two modes of tamper-indication are diagrammatically illustrated in FIGS. 5 and 6. As shown in FIG. 5, after the closure is fully seated on the container, the pilfer band 24 is positioned relative to the container locking ring L such that the flexible tabs 32 can assume a generally inwardly extending, upwardly angled disposition. The flexible tabs are preferably dimensioned so that they can flex to an out-of-the-way disposition (shown in phantom line in FIG. 5) during application of the closure to the container. With the flexible tabs 32 in the position shown in FIG. 5, removal of the closure from the container acts to urge the flexible tabs into interfering engagement with the container locking ring L whereupon the resultant stresses act to break the frangible ribs 28, so that the pilfer band is at least partially separated from the skirt portion 16.

While the above-described first mode of tamper-indication is contemplated as the primary mode in which the pilfer band 24 functions, a second mode of operation is provided as illustrated diagrammatically in FIG. 6. Specifically, in the event that one or more of the flexible tabs 32 become oriented in a relatively downwardly, inwardly extending disposition, with the frangible bridges 28 remaining intact, the tabs 32 are configured to coact with the annular interference bead 34, of the pilfer band 24. This coaction reduces the effective inside diameter of the pilfer band of the closure, and thereby effects the desired interfering engagement with the container locking ring L. This is illustrated in FIG. 6, wherein the disposition of flexible tab 32 between the container locking ring and the annular interference bead 34 provides the second arrangement for at least partially detaching the pilfer band 24 from the skirt portion 16 by fracturing bridges 28.

As will be appreciated from the above discussion, it is very desirable that any premature failure or fracture of the frangible bridges 28 be avoided during application of the closure 10 to an associated container. On the other hand, it is desirable that the frangible bridges reliably and consistently fail and fracture attendant to removal of the closure from the container.

To achieve these goals, the collective strength of the frangible bridges 28 is carefully controlled by controlling the depth to which the circumferential score 30 is cut through the closure side wall and partially into the frangible bridges. Nevertheless, it has been found that enhanced reliability can be achieved by facilitating application of the closure to a container in a manner which avoids subjecting the frangible bridges to excessive stress.

To this end, the flexible tabs 32 are configured in accordance with the present invention for enhanced flexibility. In particular, each of the flexible tabs has a generally planar configuration, including a planar portion 36. Additionally, at least some of the flexible tabs, and preferably all of them, include a locally thickened or enlarged region defined by a generally elongated pad or node 38. The pad or node of each flexible tab is positioned on the generally downwardly facing lower surface of the tab, and thus acts to define a base portion, adjacent the band portion 26, having a relatively reduced thickness to enhance the flexibility of the tab. In the preferred form, each of the tabs 32 having a pad 38 also includes a free end portion of relatively reduced thickness, compared to the central portion, with the base portion and free end portion of substantially equal thickness.

As will be appreciated by reference to FIGS. 5 and 6, the enhanced flexibility afforded by the base portion of reduced thickness facilitates the upward movement of the tabs during application of the closure to a container. At the same time, the region of relatively greater thickness at the pad 38 still assures the desired cooperation with the interference bead 34 in the second mode of tamper-indication. As shown in FIG. 6, the pad 38 of each flexible tab is engageable with the annular interference bead 34 when the tabs extend inwardly and downwardly, and are disposed between the interference bead and the container locking ring L.

Figure 4:
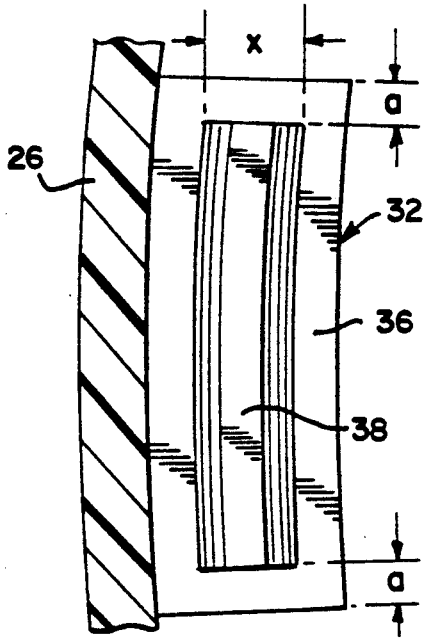
FIG. 4 is a bottom plan view of the flexible tabs shown in FIG. 2.
Figure 3:
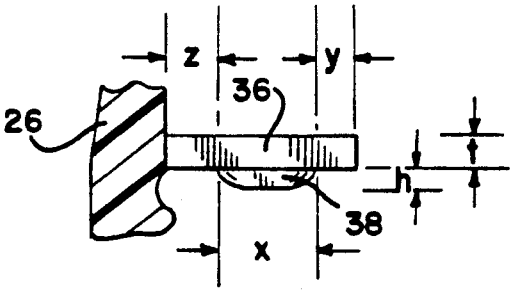
FIG. 3 is a side elevational view of the flexible tabs shown in FIG. 2.

With particular reference to FIG. 3, it is presently preferred that the pad 38 of each tab defines a generally flat surface extending between arcuate edge portions. Typical dimensions for the flexible tabs 32 are illustrated in FIGS. 3 and 4. These dimensions are intended as illustrative of a current embodiment, but are not intended to limit the invention to these presently preferred dimensional characteristics.

In a current embodiment, the planar portion 36 of each flexible tab 32 has a thickness dimension "t" on the order of about 0.005 to 0.020 inches, with the base and free end portions having this thickness dimension. The thickness or height "h" of each of the pads 38 is on the order of about 0.005 to 0.020 inches, for a total maximum tab thickness of 0.010 to 0.040 inches.

The radial dimension "x" of each pad 38 is preferably on the order of about 0.040 to 0.060 inches, with the adjacent portions of each tab having radial dimensions "y" and "z" on the order of about 0.005 to 0.015 inches, respectively. By this arrangement, the pad 38 is generally radially centered on the respective tab.

With reference to FIG. 4, the length of each flexible tab 32 is preferably on the order of about 0.200 to 0.400 inches, with the pad 38 of each tab spaced inwardly from each of the side edges of the respective tab by a dimension "a" on the order of about 0.005 to 0.015 inches.

Referring now to FIGS. 7–10, therein is illustrated a modified embodiment of the present tamper-indicating plastic closure. In most respects, the closure illustrated in these FIGURES is the same as the previously described embodiment. However, this embodiment includes a pilfer band 24, including an annular band portion 26, an annular interference bead 34, and a plurality of circumferentially spaced flexible tabs 32' which differ in some respects from the previously described flexible tabs 32.

Specifically, flexible tabs 32' each include a planar portion 36', preferably of a uniform thickness, and a locally thickened or enlarged region defined by a generally elongated pad or node 38'. The pad 38' of each flexible tab 32' is positioned on the generally downwardly facing lower surface of the tab, and thus acts to define a base portion, adjacent the band portion 26, having a relatively reduced thickness to enhance the flexibility of the tab. As in the previous embodiment, each of the tabs 32' having a pad 38' also includes a free end portion of relatively reduced thickness, compared to the central portion, with the base and free end portions of substantially equal thickness, corresponding to the thickness of planar portion 36'.

The pad 38' is preferably configured to extend over a major portion of the lower surface of planar portion 36'. With reference to FIG. 9, a current embodiment of the present closure includes 12 circumferentially spaced flexible tabs 32', with each tab having a circumferential or width dimension "f" on the order of 0.236 inches, and a corresponding dimension "p" for pad 38' thereon of 0.216 inches. Accordingly, the pad 38' is spaced inwardly from each side edge of the respective tab by about 0.010 inches. As further illustrated in FIG. 9, an inner edge portion of each of the flexible tabs 32' is generally arcuate, with these arcuate inner edges collectively defining a circle concentric with annular band 26 of the closure pilfer band. Additionally, each pad 38' preferably has inner and outer edge portions which are generally concentric with the arcuate inner edge portion of the respective flexible tab.

With reference to FIG. 7, the above-described current embodiment of the present closure is further configured such that the planar portion 36' of each flexible tab 32' has a thickness, as shown at dimension "b" of 0.011 inches, with the associated pad 38 having a thickness, shown at dimension "c", of about 0.009 inches.

As further shown in FIG. 7, the inner edge portion of each pad 38 is generally perpendicular to the adjacent surface of the planar portion 36'. The inner edge portion of the pad 38' is spaced from the inner edge portion of the respective tab by a dimension "d", which in the illustrated embodiment is on the order of 0.006 inches. Each pad 38 also includes an outer edge portion 39', generally adjacent the base portion of the respective flexible tab, which is disposed at an acute angle "$\alpha$" relative to the planar portion 36' of the tab on which the pad is positioned. In this current embodiment, angle "$\alpha$" is on the order of 35°.

As in the previous embodiment, the pads 38' of the flexible tabs 32' are engageable with the associated interference bead 34 for at least partially detaching the pilfer band 24 from the skirt portion of the closure by fracture of frangible bridges 28. As discussed hereinabove, such fracture is achieved by positioning of the flexible tabs 32' between the container locking ring L and the interference bead 34 during removal of the closure from the associated container. The tabs 32', including the relatively thick portions at pads 38', cooperate with the interference bead 34 to increase the effective inside diameter of the pilfer band. By this action, sufficient interference is created with the container locking ring to effect fracture of the frangible bridges 28.

Disposition of the pad 38' on the generally downwardly facing surface of the planar portion 36' of the associated pad 32' is believed to desirably enhance the interference force or "pull strength" which is created during closure removal, thereby acting to assure the intended fracture of the pilfer band for enhanced tamper-indication. This is believed to result from the cooperation of the flexible tabs 32' with the interference bead 34 such that substantial horizontal force components, rather than vertical force components, are created during interference with the container locking ring, as the pad 38' engages the interference bead. This engagement takes place at or near the angular outer edge 39' of the pad 38' and is believed to direct force components horizontally, which components are best resisted by the circumferential hoop strength of the annular band portion 26 of the pilfer band. Rather than subjecting the tabs 38' to stretching and deformation during closure removal, compressive forces are created which are directed in a manner in which the closure is best capable of resisting such forces without undesired deformation.

At the same time, the desired enhanced flexibility is achieved by virtue of the formation of each pad 32' with a base portion of relatively reduced thickness, which acts to assure high-speed application of the closure to a container without premature failure or fracture. By configuring the pad 38' to cover the major portion of the respective surface of planar portion 36', the tab 32' exhibits enhanced resistance to buckling and deformation, again with the desired flexibility achieved by virtue of the relatively reduced thickness at the base portion. The illustrated configuration is also believed to desirably enhance cooling during molding.

The high degree of tamper-resistance achieved by the cooperation between flexible tabs 32' and the associated interference bead enhances the versatility of the present closure construction. As discussed above, it is most preferred that the present closure be configured for two modes of tamper-indication, as respectively illustrated in FIGS. 10 and 11.

In a first mode of tamper-indication, flexible tabs 32' extend angularly upwardly and inwardly (as shown in phantom line in FIG. 10) so that the inner edge or free end portions of the flexible tabs are positioned for interfering engagement with the container locking ring L. The flexible tabs 32' move to this inwardly angled disposition from a substantially upwardly extending disposition (shown in solid line in FIG. 10) which vertical position the tabs assume as the closure is applied to the associated container. The resilience of the tabs causes them to move from this initial out-of-the-way disposition to the inwardly and upwardly extending disposition for the first mode of tamper-indication.

Figure 11:
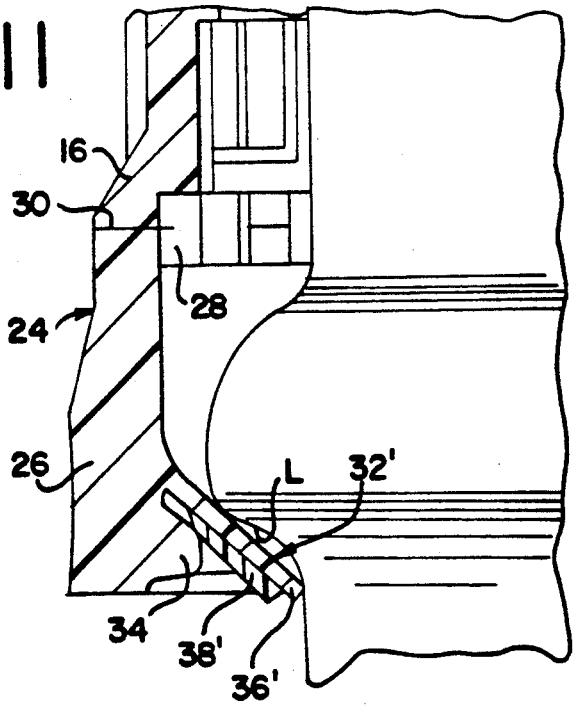
FIG. 11 is a view similar to FIG. 10 illustrating the present closure in a second mode of tamper-indication.

The second mode of tamper-indication, shown in FIG. 11, functions by decreasing the effective inside diameter of the pilfer band. In this mode of operation, the tabs 32' extend inwardly and downwardly, and are positionable between the container locking ring and the annular interference bead 34. As noted above, the tabs 38' of each flexible tab 32' are engageable with the interference bead at or near the angular outer edge of each pad, with the illustrated configuration desirably acting to create horizontally directed compressive forces, attendant to closure removal, which are resisted by the hoop strength of the band portion 26 of the pilfer band. Fracture of frangible bridges 28 is thus effected.

Notably, a pilfer band made in accordance with the present invention can be configured to function reliably in the second mode of tamper-indication, without reliance upon the first mode. Specifically, and with reference to dimension "r" shown in FIG. 7, tabs 32' can be configured to have a length "r" on the order of 0.101 inches if it is desired that the flexible tabs be configured for the above-described two modes of tamper-indication.

In contrast, the tabs can be relatively shortened, by providing them with a dimension "r" on the order of 0.086 inches, if the tabs are to effect tamper-indication only in the downwardly, inwardly extending disposition of the tabs, by disposition between the container locking ring "r" and the annular interference bead 34. In this arrangement, the tabs initially move downwardly during closure removal from their upwardly, inwardly dispositions without fracture of bridges 28. The bridges 28 then fracture with the tabs extending downwardly and inwardly. Again, this versatility is believed to be achieved, at least in part, by configuring the pads 38 so that they are engageable with the annular interference bead, in accordance with the illustrated embodiments of the present invention.

From the foregoing, it will be observed that numerous modifications and variations can be effected without departing from the true spirit and scope of the novel concept of the present invention. It is to be understood that no limitation with respect to the specific embodiment is intended or should be inferred. The disclosure is intended to cover by the appended claims all such modifications as fall within the scope of the claims.

What is claimed is:

1. A tamper-indicating plastic closure for a container having an annular locking ring, said closure comprising:

a plastic cap including a top wall portion, and an annular depending cylindrical skirt portion, and an annular pilfer band depending from said skirt portion and at least partially detachably connected to said skirt portion by frangible means, said pilfer band including an annular band portion, and inwardly extending flexible tab means comprising a plurality of circumferentially spaced, flexible tabs extending inwardly of said annular band portion, and inwardly extending interference bead means positioned beneath said tab means, said flexible tabs of said tab means being positionable between said container locking ring and said interference bead means during removal of said closure from said container for at least partially detaching said pilfer band from said skirt portion by fracture of said frangible means, wherein at least some of said flexible tabs are configured for enhanced flexibility, and include a central portion having a relatively thick pad means, said pad means defining a base portion of said tab having a relatively reduced thickness adjacent said annular band portion to enhance the flexibility of the tab, said pad means of each said tab having an edge portion generally adjacent the base portion of the respective flexible tab, said pad means of each said flexible tab being engageable with said interference bead means at the region of said pad means edge portion when said flexible tabs are positioned between said container locking ring and said interference bead means for fracture of said frangible means.

2. A tamper-indicating plastic closure in accordance with claim 1, wherein the thickness of each said flexible tab, including said base portion, is about 0.005 to 0.020 inches, and said pad means has an additional thickness of about 0.005 to 0.020 inches.

3. A tamper-indicating plastic closure in accordance with claim 2, wherein the thickness of each said flexible tab is about 0.011 inches, and said pad means has a thickness of about 0.009 inches.

4. A tamper-indicating plastic closure for a container having an annular locking ring, said closure comprising:

a plastic cap including a top wall portion, and an annular, depending cylindrical skirt portion, and an annular pilfer band depending from said skirt portion and at least partially detachably connected to said skirt portion by frangible means, said pilfer band including flexible tab means comprising a plurality of circumferentially spaced, flexible tabs extending inwardly of said pilfer band and each having a free end portion, and inwardly extending interference bead means positioned beneath and adjacent to said tab means, said flexible tabs of said tab means being positionable between said container locking ring and said interference bead means during removal of sid closure from said container for at least partially detaching said pilfer band from said skirt portion by fracture of said frangible means, wherein at least some of said flexible tabs are configured for enhanced flexibility, and have a relatively thick pad means, and a base portion of said tab having a relatively reduced thickness to enhance the flexibility of the tab, said pad means of each said tab having an edge portion generally adjacent the base portion of the respective flexible tab, each said relatively thick pad means extending over a major portion of a surface of said flexible tab on which said pad means is positioned, each said flexible tab having a uniform thickness, including said base portion, of about 0.005 to 0.020 inches, each said pad means having an additional thickness of about 0.005 to 0.020 inches.

5. A tamper-indicating plastic closure in accordance with claim 4, wherein each said relatively thick pad means defines a generally flat surface substantially parallel to a planar opposite surface of the respective tab.

6. A tamper-indicating plastic closure in accordance with claim 4, wherein said relatively thick pad means is positioned on a lower surface of the respective flexible tab and is engageable with said interference bead means, said pad means having a uniform thickness.

7. A tamper-indicating plastic closure for a container having an annular locking ring, said closure comprising:

a plastic cap including a top wall portion, and an annular depending cylindrical skirt portion, and an annular pilfer band depending from said skirt portion and at least partially detachably connected to said skirt portion by frangible means, said pilfer band including an annular band portion, and inwardly extending flexible tab means comprising a plurality of circumferentially spaced, flexible tabs extending inwardly of said annular band portion, and inwardly extending interference bead means positioned beneath said tab means, said flexible tabs of said tab means being positionable between said container locking ring and said interference bead means during removal of said closure from said container for at least partially detaching said pilfer band from said skirt portion by fracture of said frangible means, wherein at least some of said flexible tabs are configured for enhanced flexibility, and include a central portion having a relatively thick pad means, said pad means defining a base portion having a relatively reduced thickness adjacent said annular band portion to enhance the flexibility of the tab, said pad means of each said flexible tab being engageable with said interference bead means when said flexible tabs are positioned between said container locking ring and said interference bead means for fracture of said frangible means, said pad means being spaced inwardly from each side edge of the respective tab by about 0.005 to 0.015 inches.

8. A tamper-indicating plastic closure in accordance with claim 1, wherein said pad means is spaced inwardly from each side edge of the respective tab by about 0.010 inches.

9. A tamper-indicating plastic closure for a container having an annular locking ring, said closure comprising:

a plastic cap including a top wall portion, and an annular depending cylindrical skirt portion, and an annular pilfer band depending from said skirt portion and at least partially detachably connected to said skirt portion by frangible means, said pilfer band including an annular band portion, and inwardly extending flexible tab means comprising a plurality of circumferentially spaced, flexible tabs extending inwardly of said annular band portion, and inwardly extending interference bead means positioned beneath said tab means, said flexible tabs of said tab means being positionable between said container locking ring and said interference bead means during removal of said closure from said container for at least partially detaching said pilfer band from said skirt portion by fracture of said frangible means, wherein at least some of said flexible tabs are configured for enhanced flexibility, and include a central portion having a relatively thick pad means, said pad means defining a base portion having a relatively reduced thickness adjacent said annular band portion to enhance the flexibility of the tab, said pad means of each said flexible tab being engageable with said interference bead means when said flexible tabs are positioned between said container locking ring and said interference bead means for fracture of said frangible means, an inner edge portion of each said flexible tab being generally arcuate, said pad means having inner and outer edge portions which are generally concentric with the arcuate inner edge portion of the respective flexible tab.

10. A tamper-indicating plastic closure for a container having an annular locking ring, said closure comprising:

a plastic cap including a top wall portion, and an annular depending cylindrical skirt portion, and an annular pilfer band depending from said skirt portion and at least partially detachably connected to said skirt portion by frangible means, said pilfer band including an annular band portion, and inwardly extending flexible tab means comprising a plurality of circumferentially spaced, flexible tabs extending inwardly of said annular band portion, and inwardly extending interference bead means positioned beneath said tab means, said flexible tabs of said tab means being positionable between said container locking ring and said interference bead means during removal of said closure from said container for at least partially detaching said pilfer band from said skirt portion by fracture of said frangible means, wherein at least some of said flexible tabs are configured for enhanced flexibility, and include a central portion having a relatively thick pad means, said pad means defining a base portion having a relatively reduced thickness adjacent said annular band portion to enhance the flexibility of the tab, said pad means of each said flexible tab being engageable with said interference bead means when said flexible tabs are positioned between said container locking ring and said interference bead means for fracture of said frangible means, an inner edge portion of each said pad means being generally perpendicular to the adjacent surface of the respective flexible tab, each said pad means including an outer edge portion, generally adjacent said base portion of the respective flexible tab, which is disposed at an acute angle relative to a planar portion of the tab on which the pad means is positioned.

* * * * *

UNITED STATES PATENT AND TRADEMARK OFFICE

CERTIFICATE OF CORRECTION

PATENT NO. : 5,205,426

DATED : April 27, 1993

INVENTOR(S) : Stephen W. McBride and Thomas J. McCandless

It is certified that error appears in the above-identified patent and that said Letters Patent is hereby corrected as shown below:

Col. 10, Claim 8, line 68 Change "1" to --7--.

Signed and Sealed this

First Day of February, 1994

Bruce Lehman

*Attest:*

BRUCE LEHMAN

*Attesting Officer*

*Commissioner of Patents and Trademarks*